United States Patent [19]

Nagae et al.

[11] 4,395,709

[45] Jul. 26, 1983

[54] DRIVING DEVICE AND METHOD FOR MATRIX-TYPE DISPLAY PANEL USING GUEST-HOST TYPE PHASE TRANSITION LIQUID CRYSTAL

[75] Inventors: Yoshiharu Nagae; Masaaki Kitajima, both of Hitachi; Hideaki Kawakami, Mito, all of Japan

[73] Assignee: Hitachi, Ltd., Tokyo, Japan

[21] Appl. No.: 258,625

[22] Filed: Apr. 29, 1981

[30] Foreign Application Priority Data

May 2, 1980 [JP] Japan ..... 55/57837

[51] Int. Cl.[3] ..... G09F 9/32

[52] U.S. Cl. ..... 340/784; 340/811

[58] Field of Search ..... 340/783, 784, 791, 805, 340/811; 350/346

[56] References Cited

U.S. PATENT DOCUMENTS 4,186,395 1/1980 Fujita ..... 340/805

4,317,115 2/1982 Kawakami et al. ..... 340/784

FOREIGN PATENT DOCUMENTS 55-46788 4/1980 Japan .

OTHER PUBLICATIONS

"Pulse-Length Modulation Achieves Two-Phase Writing Matrix-Addressed Liquid-Crystal Information Displays", Walter, et al., IEEE Transactions on Elec. Devices Ed-25(2), pp. 172-174, 1978, Feb.

*Primary Examiner*—Michael A. Masinick

*Attorney, Agent, or Firm*—Antonelli, Terry & Wands

[57] ABSTRACT

An apparatus and a method for driving a guest-host type phase transition liquid crystal in matrix is disclosed in which X and Y electrodes in matrix comprising a guest-host liquid crystal made by adding a pleochroic dye to the cholesteric-nematic phase transition liquid crystal or chiralnematic phase transition liquid crystal are impressed with an X electrode selecting voltage, an X electrode non-selecting voltage, a Y electrode selecting voltage and a Y electrode non-selecting voltage selectively thereby to apply a holding voltage for holding the display condition of the liquid crystal cells of the liquid crystal display elements and a write-in voltage for new write-in. The region where the display condition is to be erased is designated in the liquid crystal display panel. The X and Y electrodes in that region are impressed with the X electrode non-selecting voltage, the other Y electrodes are impressed with the Y electrode selecting voltage, the other X electrodes are impressed with an erasure holding voltage having a continuously repetitive pulse waveform including one cycle of the Y electrode non-selecting voltage and three cycles of Y electrode selecting voltage, so that the liquid crystal cells in the designated region are supplied with the erasure voltage and the other liquid crystal cells are supplied with the holding voltage, thus erasing the designated region alone.

6 Claims, 14 Drawing Figures

DRIVING DEVICE AND METHOD FOR MATRIX-TYPE DISPLAY PANEL USING GUEST-HOST TYPE PHASE TRANSITION LIQUID CRYSTAL

The present invention relates to a method of driving a liquid crystal display apparatus, or more in particular to a method of driving a liquid crystal display apparatus most suitably applied to a guest-host type liquid crystal display apparatus in which a pleochroic dye is added to a cholesteric-nematic phase transition liquid crystal or a chiralnematic phase transition liquid crystal.

The amplitude selective multiplexing method is generally used for driving the twisted nematic mode liquid crystal display apparatus as a method for driving the liquid crystal display apparatus of matrix type.

The voltage-brightness characteristic of the twisted nematic mode liquid crystal display panel is such that the brightness is determined by the effective voltage as shown in FIG. 1A. Therefore, the display modes ① and ② are determined by the writing voltage $V_S$ and the non-writing voltage $V_{NS}$ respectively obtained by the amplitude selection multiplexing method, thus making the display of brightness possible.

On the other hand, FIG. 1B shows the voltage-brightness characteristic of a guest-host type liquid crystal display panel with a pleochroic dye added to a cholesteric-nematic phase transition liquid crystal or a chiralnematic phase transition liquid crystal. As seen from this graph, the curve assumes a what is called a hysteresis characteristic as the voltage increase and decrease follow different routes.

When the crystal is driven by the two driving voltages $V_S$ and $V_{NS}$ according to the amplitude selective multiplexing method as shown in FIG. 1B, therefore, the image cell once written and brought to the bright stage ① by the voltage $V_S$ does not change to the dark state ② but is held at the bright state ③ even upon application thereto of the next non-writing voltage $V_{NS}$. For this reason, it is impossible to effect writing and erasure freely only by the writing voltage $V_S$ and the non-writing voltage $V_{NS}$ according to the conventionally known amplitude selective multiplexing method.

In order to obviate this shortcoming, a driving method has been suggested actively utilizing the above-mentioned hysteresis characteristic. Examples of such a method are disclosed in an article entitled "Pulse-length Modulation Achieves Two-Phase Writing Matrix-Addressed Liquid-Crystal Information Displays" by K. H. Walter et al., IEEE Trans. on Electron Device, ED-25(2), pp. 172 to 174, 1978; Japan Patent Kokai (Laid-Open) No. 46788/80 published on Apr. 2, 1980; and U.S. patent application Ser. No. 98,666 filed on Nov. 29, 1979. According to these disclosures, first, the liquid crystal cells to be written are impressed with the writing voltage $V_S$ and the liquid crystal cells not to be written are impressed with the non-writing voltage $V_{NS}$ thereby to bring only the cells to be written to a bright state, followed by application of a voltage approximate to the non-writing voltage to all the liquid crystal cells, thus holding the display state. In this way, by making use of the hysteresis characteristic, the voltage (holding voltage) corresponding to the intermediate portion of the particular characteristic curve is applied to hold the display condition, thereby greatly simplifying the method of application of a drive voltage for new writing and holding of the written condition.

In the above-mentioned driving system, it is seen that the display may be rewritten or erased by reducing the applied voltage for all the liquid crystal cells to zero. Accordingly, the entire display may be erased by making the voltages of all the X and Y electrodes equal to each other and thus reducing to zero the voltages applied to the liquid crystals interposed between the X and Y electrodes.

In an ordinary display apparatus, only one character or one portion may be required to be erased. The partial erasure is attained by reducing to zero the voltage applied to the image elements associated with the part to be erased while driving the other image elements with the holding voltage $V_H$. In spite of this, a suitable method is not yet developed to perform this operation by driving electrodes in matrix.

In many cases, therefore, the partial erasure is effected in such a manner that the entire display is erased first immediately followed by the rewriting of the parts not to be erased. This method is not suitable for a liquid crystal display panel in which the response speed is so low that the erasure or writing requires several hundred ms.

The object of the present invention is provide a system and a method of driving a liquid crystal display apparatus in which partial erasure is possible by directly erasing desired part of the display.

According to the present invention, a waveform for partial erasure is added to the four basic waveforms used in the conventional amplitude selective multiplexing method, so that the liquid crystal cells to be erased are supplied with a voltage of the same waveform while the other liquid crystal cells are supplied with the holding voltage $V_H$.

The above and other objects, features and advantages will be made apparent by the detailed description taken in conjunction with the accompanying drawings, in which.

Figure 1A:
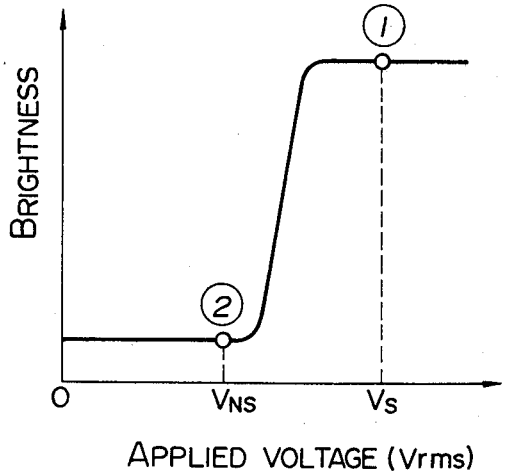
FIG. 1A PRIOR ART
FIG. 1A shows the photo-electric characteristic of a twisted nematic mode liquid crystal.
Figure 1B:
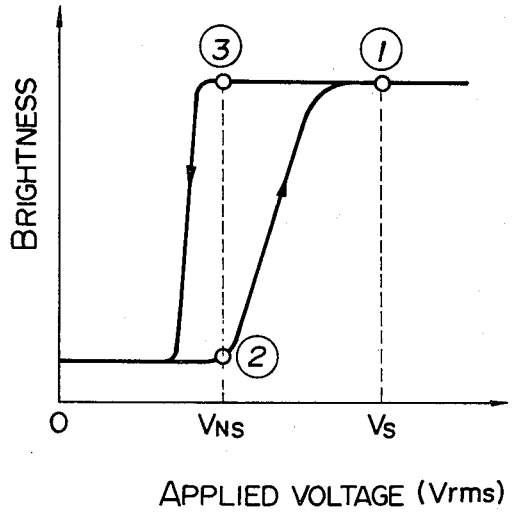
FIG. 1B PRIOR ART
FIG. 1B shows the photo-electric characteristic of a guest-host type liquid crystal.
Figure 2:
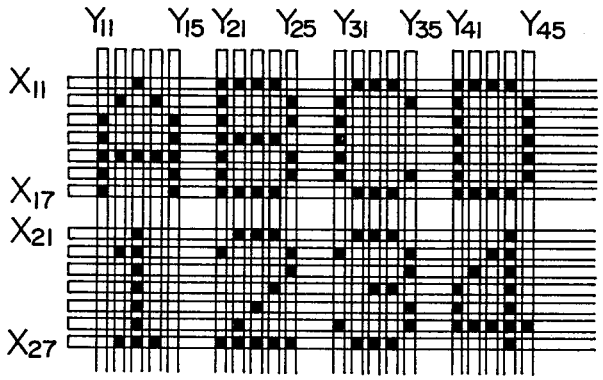
FIG. 2 is a diagram schematically showing a liquid crystal display panel for displaying one character with 35 ($=5\times7$) dots.

The present invention will be described in detail with reference to the case in which characters each comprised of 5×7 dots as shown in FIG. 2 are displayed in two lines.

A schematic diagram of a liquid crystal display panel for displaying one character by every 5×7 dots is shown in FIG. 2 with an electrode structure in the X-Y matrix. In this case, each character is displayed by seven X electrodes and five Y electrodes, an image element being formed of each liquid crystal cell at the crossing of the X and Y electrodes. To facilitate the understanding, a display panel for displaying eight characters in two lines is shown.

Figure 3:
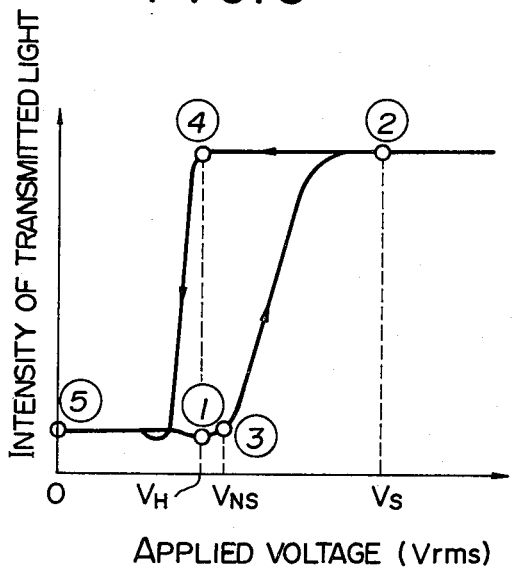
FIG. 3 shows the photo-electric characteristic of the liquid crystal display panel of FIG. 2.

The voltage-brightness characteristic of the display panel of FIG. 2 is shown in FIG. 3. The method of driving the liquid crystal cells will be described below with reference to FIGS. 2 and 3.

First, in the case where a character is written in the first line, the well known amplitude selective multiplexing method is used by the line-at-a-time scanning of the X electrodes $X_{11}$ to $X_{17}$ corresponding to the first line (duty ratio of 1/7). The liquid crystals to be written are driven by the writing voltage $V_S$ and the liquid crystal cells not to be written are driven by the non-writing voltage $V_{NS}$. If the values of $V_S$ and $V_{NS}$ are determined as shown in FIG. 3, therefore, the liquid crystal cells to be written assume the bright state ② and the liquid crystal cells not to be written assume the dark condition ③ thereby to display predetermined characters. In this case, the X electrodes $X_{21}$ to $X_{27}$ corresponding to the second line are not scanned but supplied with an appropriate drive waveform so that the effective voltage applied to the image elements in the second line is maintained at the holding voltage $V_H$, thus keeping the X electrodes $X_{21}$ to $X_{27}$ in the dark display condition ①.

For writing in the second line, the line-at-a-time scanning is transferred to the X electrodes $X_{21}$ to $X_{27}$ associated with the second line, while the X electrodes $X_{11}$ to $X_{17}$ associated with the first line are not scanned but impressed with the holding voltage $V_H$. Thus the second line is written by the writing voltage $V_S$ and the non-writing voltage $V_{NS}$ according to the amplitude selective multiplexing method and changes from the condition ① to the condition ② or ③ for effecting the predetermined display.

Since the liquid crystal cells for the first line are driven by the holding voltage $V_H$, the condition thereof changes from ② to ④ or from ③ to ① and the display is held.

In this way, even a display involving a number of lines is effected by writing the lines one by one sequentially.

Figure 4:
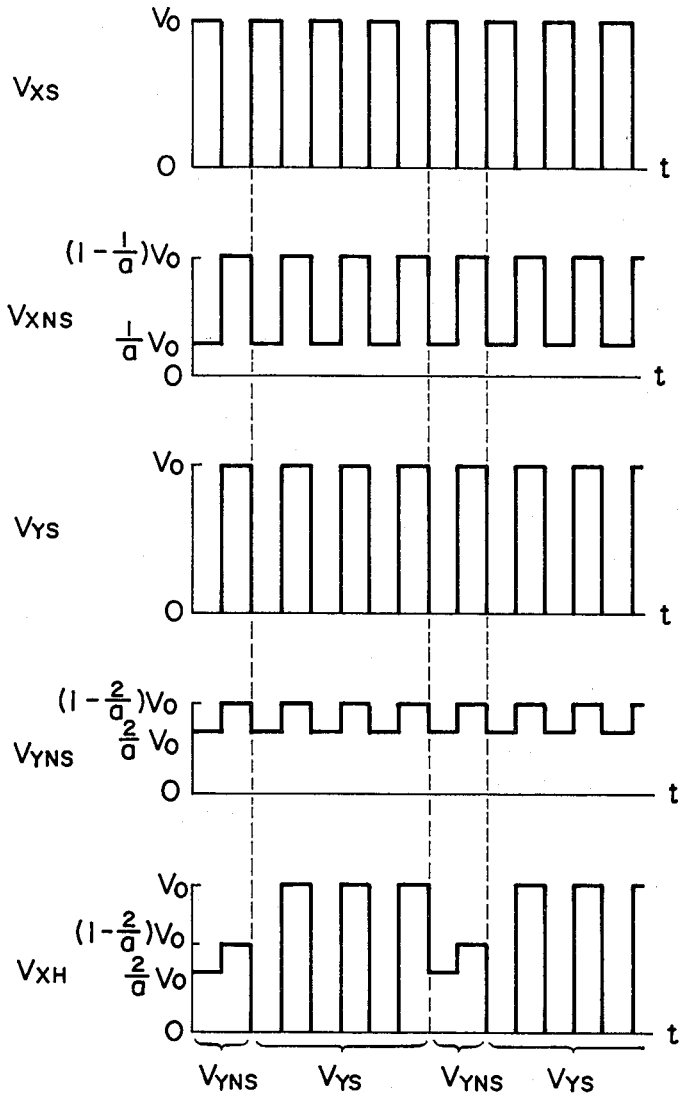
FIG. 4 shows voltage waveforms for explaining the operating principle of the present invention.

Drive voltage waveforms used in the present invention are shown in FIG. 4. The X electrode selecting voltage $V_{XS}$, the X electrode non-selecting voltage $V_{XNS}$, the Y electrode selecting voltage $V_{YS}$ and the Y electrode non-selecting voltage $V_{YNS}$ are used for the well-known amplitude selective multiplexing method. The bias ratio a may be determined as desired and called the voluntary bias waveform (1/a bias waveform). The erasure holding voltage $V_{XH}$ shown in FIG. 4 is employed for the first time in this invention and is formed of a waveform equivalent to the voltage $V_{YNS}$ during one clock pulse within one cycle (four clock pulses) and a waveform equivalent to the voltage $V_{YS}$ during the other three clock pulses.

Figure 5:
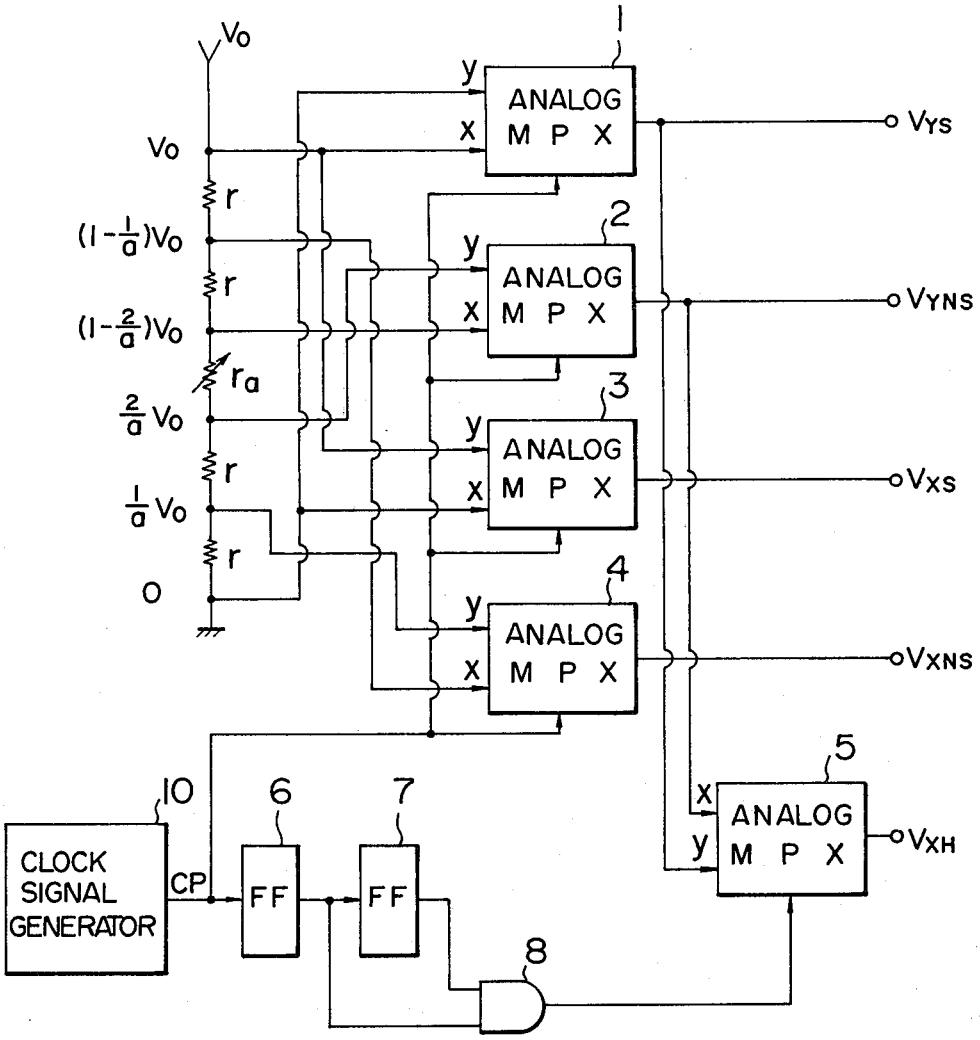
FIG. 5 is a circuit diagram showing an embodiment of the present invention.

A specific circuit for producing the waveforms of FIG. 4 is shown in FIG. 5. The source voltage $V_0$ is connected to a series circuit of five resistors including four fixed resistors r and one variable resistor $r_a$ for producing six divided voltages $V_0$, $(1-1/a)V_0$, $(1-2/a)V_0$, $(2/a)V_0$ and 0 from the respective junction points of the resistors, where a is the bias ratio given as $a=(4r+r_a)/r$. These voltages are applied to the analog multiplexers 1, 2, 3 and 4 respectively. Each of the analog multiplexers has two inputs and one output. Specifically, the analog multiplexer 1 is impressed with the voltages $V_0$ and 0 and produces the voltage $V_{YS}$; the analog multiplexer 2 is impressed with the inputs $(1-2/a)V_0$ and $(2/a)V_0$ and produces the output voltage $V_{YNS}$; the analog multiplexer 3 is supplied with the inputs $V_0$ and 0 and produces the voltage $V_{XS}$; and the analog multiplexer 4 is supplied with the inputs $(1-1/a)V_0$ and $(1/a)V_0$ and produces the voltage $V_{XNS}$. The output of these multiplexers is controlled by the clock pulse CP from the clock signal generator 10. This clock pulse CP takes a rectangular waveform synchronous with the waveforms of FIG. 4 and has a duty factor of 50%, thus forming one period with the first-half "0" level signal and the second-half "1" level signal. When this clock pulse CP is applied to the multiplexers 1, 2, 3 and 4 as a selecting signal, a y input is produced in response to the "0" level signal and an x input is produced in response to the "1" level signal.

The output $V_{YS}$ of the analog multiplexer 1 and the output $V_{YNS}$ of the analog multiplexer 2 are applied to the analog multiplexer 5 in response to which the voltage $V_{XH}$ is produced from the latter. The control signal for this analog multiplexer 5 is supplied by the output of the AND gate 8 supplied with the signal derived through the flip-flops 6 and 7 and the clock pulse CP. This control signal has a period equal to four periods of the clock pulse CP and is at "1" level for one period of the clock pulse. As a result, the erasure holding voltage $V_{XH}$ shown in FIG. 4 is obtained at the output of the multiplexer 5.

Figure 6:
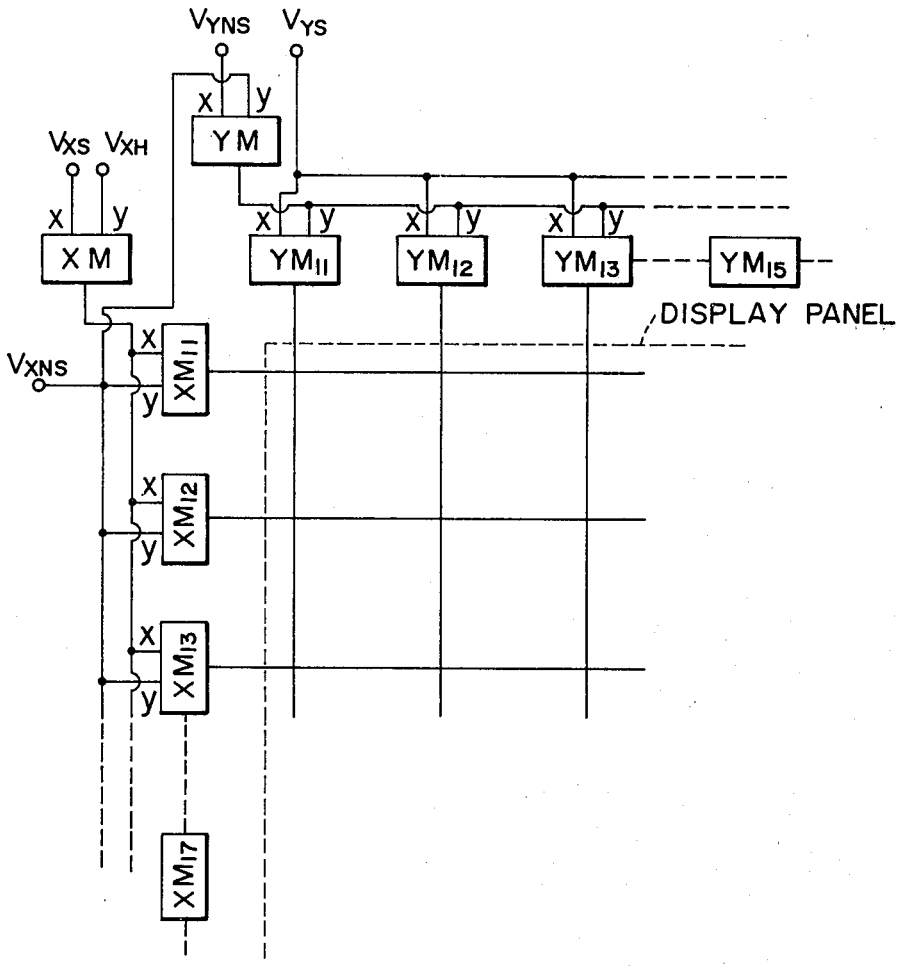
FIG. 6 is a diagram showing a driving circuit according to an embodiment of the present invention.

In order to actually drive the liquid crystal display panel by these waveform voltages, the driver circuit shown in FIG. 6 may be used. The driver circuit in this drawing also has the same construction as the above-mentioned analog multiplexers so that it produces the x input in response to the control signal of "1" level and the y input in response to the control signal of "0" level. For the purpose of displaying the 5×7 dots as shown in FIG. 2, the analog multiplexers for driving the X electrodes are divided into groups of $XM_{11}$ to $XM_{17}$ and $XM_{21}$ to $XM_{27}$ respectively corresponding to the first and second lines. In similar fashion, the analog multiplexers for driving the Y electrodes are divided into and called groups of $YM_{11}$ to $YM_{15}$, $YM_{21}$ to $YM_{25}$ and so on respectively corresponding to the first, second character and so on as counted from the left side.

The display operation of the driver circuit shown in FIG. 6 will be described. A "1" control input is applied both to the two analog multiplexers XM and YM. Since the analog multiplexers XM and YM produce the x input thereof, the input terminals of the analog multiplexers $XM_{11}$ to $XM_{17}$, $XM_{21}$ to $XM_{27}$ in the next stage are supplied with the voltage $V_{XS}$, and the input terminals of the analog multiplexers $YM_{11}$ to $YM_{15}$, $YM_{21}$ to $YM_{25}$, $YM_{31}$ to $YM_{35}$ and so on are supplied with the voltage $V_{YNS}$. As a result, the voltage $V_{XS}$ or $V_{XNS}$ is produced at the outputs of the analog multiplexers $XM_{11}$ to $XM_{17}$ and $XM_{21}$ to $XM_{27}$, while the analog multiplexers $YM_{11}$ to $YM_{15}$, $YM_{21}$ to $YM_{25}$ and so on produce the voltage $V_{YS}$ or $V_{YNS}$, thus making possible the operation quite similar to that by the ordinary amplitude selective multiplexing method.

In the case where the first line is written, for instance, the cells are scanned to apply the control input of "1" to the analog multiplexers $XM_{11}$ to $XM_{17}$ representing the first line sequentially. This scanning is a line-at-a-time scanning of 1/7 duty as it is aimed at the seven analog multiplexers $XM_{11}$ to $XM_{17}$.

Figure 7:
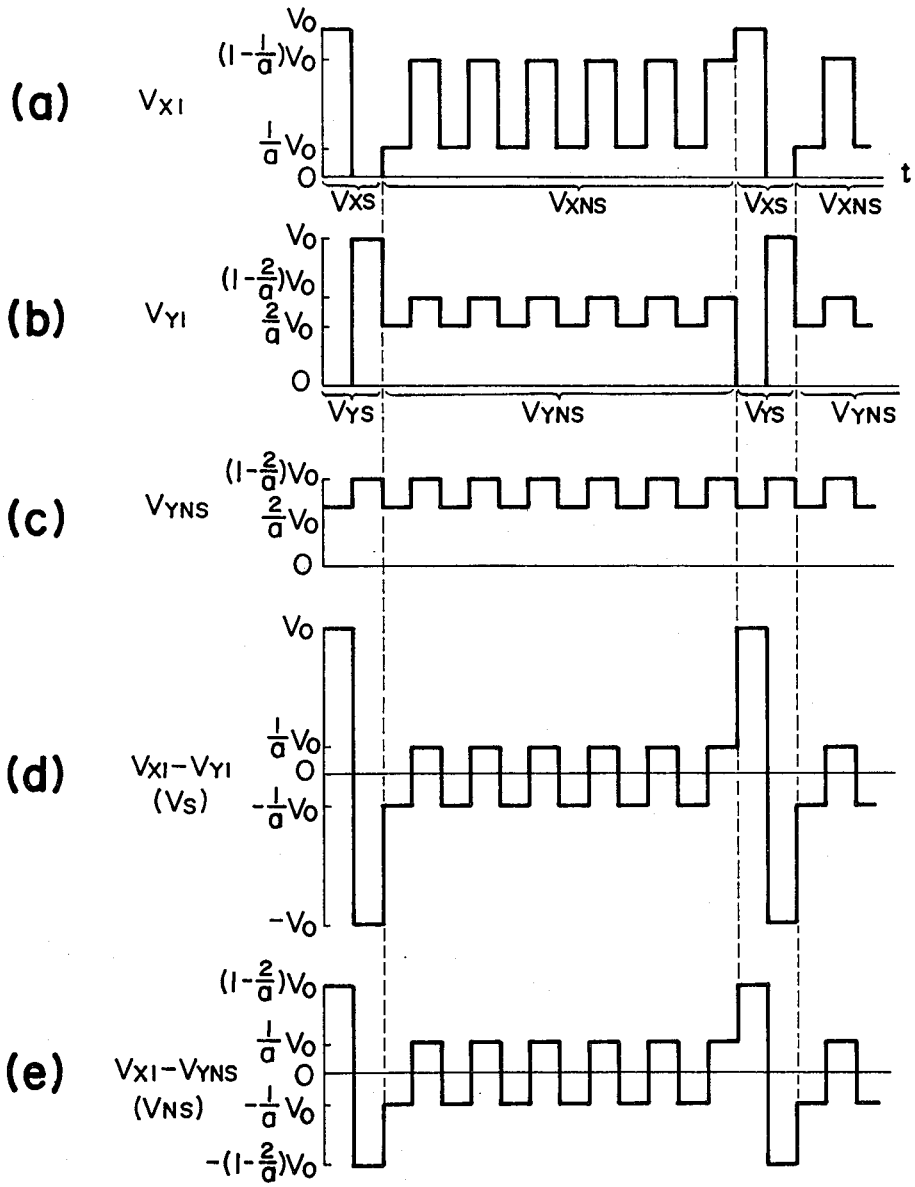
FIG. 7 shows waveforms of the voltages applied to the electrodes and liquid crystal cells associated with a designated line for writing.

Thus the output $V_{X1}$ of the multiplexer $XM_{11}$ takes the form as shown in FIG. 7(*a*) in which the voltage $V_{XS}$ is produced only once in each period, the other six pulses taking the voltage value of $V_{XNS}$, which voltages are applied to the X electrode $X_{11}$. The outputs of the multiplexers $XM_{12}$, $XM_{13}$ and so on, on the other hand, take a waveform of the voltage $V_{XS}$ retarded by one clock pulse in application time.

The analog multiplexers $YM_{11}$, $YM_{12}$ and so on are supplied with a "1" or "0" control input signal in accordance with the character pattern to be displayed. In other words, the Y electrode corresponding to the write-in cell is supplied with the voltage $V_{YS}$ once in a period as shown in FIG. 7(*b*) in synchronism with the period of application of the voltage $V_{YS}$ to the X electrode corresponding to the write-in cell, and the voltage $V_{YNS}$ is applied to the Y electrode as the remaining six pulses. The Y electrode corresponding to the non-write-in cell is impressed with the voltage $V_{YNS}$ continuously as shown in FIG. 7(*c*). In view of the fact that the voltage applied to the liquid crystals is equal to the voltage difference between the X and Y electrodes of each liquid crystal, the voltage applied to the write-in cell is $V_{X1}-V_{Y1}$ and the voltage applied to the non-write-in cell is $V_{X1}-V_{YNS}$. Therefore, the write-in cell is supplied with the voltage of the waveform shown in FIG. 7(*d*), while the non-write-in cell is impressed with the voltage of the waveform shown in FIG. 7(*e*). Thus the effective values $V_S$ and $V_{NS}$ of these voltages are given as $$V_S = \frac{V_0}{a}\sqrt{1+\frac{(a+1)(a-1)}{7}} \quad (1)$$

$$V_{NS} = \frac{V_0}{a}\sqrt{1+\frac{(a-1)(a-3)}{7}} \quad (2)$$

By using this drive waveform, the effective voltage for driving the write-in cells and the non-write-in cells takes the value $V_S$ or $V_{NS}$ regardless of the write-in pattern.

Figure 8:
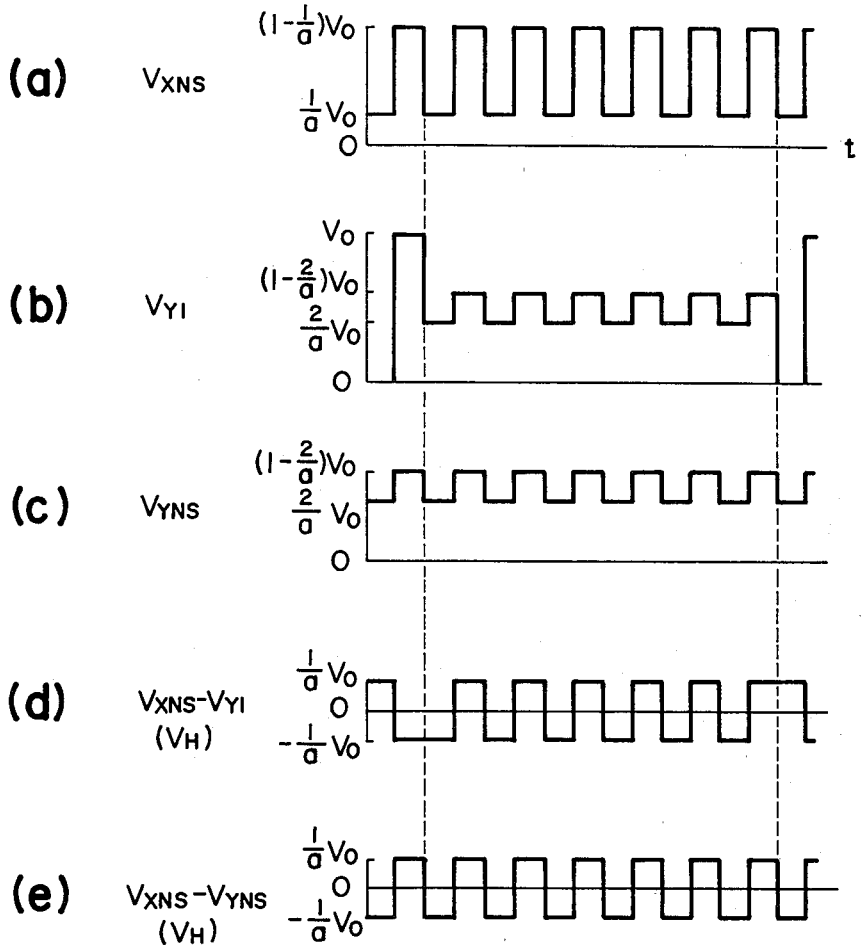
FIG. 8 shows waveforms of the voltages applied to the electrodes and the liquid crystal cells associated with the non-designated lines for writing.

If the second line is not scanned and the control input of the analog multiplexers $XM_{21}$ to $XM_{27}$ is kept at "0", the non-write-in voltage $V_{XNS}$ for the X electrode is produced directly at the output terminal thereof as shown in FIG. 8(*a*). In this case, the effective voltage applied to the liquid crystal cells is expressed as below regardless of whether the outputs of the analog multiplexers $YM_{11}$, $YM_{12}$ and so on take the value $V_{YS}$ or $V_{YNS}$.

$$V_H=(1/a)V_O \quad (3)$$

It is seen that if the waveforms of FIGS. 8(*b*) and 8(*c*) are supplied, the voltages applied to the liquid crystals take the forms of (d) and (e) which have different waveforms but the same effective voltage given as the equation (3).

Upon completion of the write-in of the first line, the second line is written in. The control inputs of the analog multiplexers $XM_{21}$ to $XM_{27}$ corresponding to the second line are scanned and the control inputs of the analog multiplexers $XM_{11}$ to $XM_{17}$ associated with the first time are kept "0", so that non-selecting voltage $V_{XNS}$ is applied to the X electrodes $X_{11}$ to $X_{17}$. Thus the liquid crystal cells of the second line are driven by the voltage $V_S$ or $V_{NS}$ in accordance with the display pattern, whereas all the liquid crystal cells of the first line are driven by the voltage $V_H$.

In this way, the liquid crystal cells of the line being subjected to the line-at-a-time scanning are brought into the state ② or ③ in FIG. 3, and the liquid crystal cells in the other lines are driven by the voltage $V_H$, so that the state ④ or ① is attained and the written display is held in the lines already written. On the other hand, the lines not yet written in are kept at the state ①.

The erasing operation will be described. When erasing the whole panel at the same time, all the analog multiplexers $XM_{11}$, $XM_{12}$ and so on for the X electrodes are impressed with the control input of "0" level, so that all the X electrodes are impressed with the voltage $V_{XNS}$. The control input of "0" level is applied to all the analog multiplexers YM for the Y electrodes thereby to produce the output voltage $V_{XNS}$. Thus all the control inputs of the analog multiplexers $YM_{11}$, $YM_{12}$ and so on for the Y electrodes are made "0" thereby to produce the voltage $V_{XNS}$ at all the Y electrodes. Under this condition, the electrodes on both sides of the liquid crystal are driven by the same voltage $V_{XNS}$, and therefore the voltage applied to the liquid crystals are zero, so that the state ⑤ in FIG. 3 is attained, thus erasing the whole panel.

Figure 9:
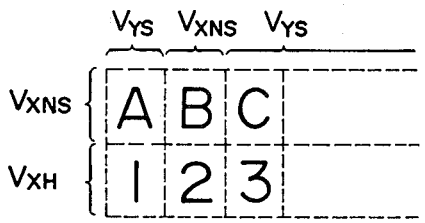
FIG. 9 is a diagram for explaining the voltage applied to each block of liquid crystals on the display panel.

In the case where partial erasure is desired, the above-mentioned basic waveform $V_{XH}$ is used. Explanation will be made below with reference to the case in which only the second character "B" in the first line is to be erased as shown in FIG. 9.

First, the control input of the analog multiplexer XM is reduced to "0" thereby to produce the voltage $V_{XH}$ therefrom. Further, the control inputs of the analog multiplexers $XM_{11}$ to $XM_{17}$ corresponding to the first line are reduced to "0" thereby to produce the output $V_{XNS}$ therefrom. Also, the control input of "1" level is applied to the analog multiplexers $XM_{21}$ to $XM_{27}$ associated with the second line thereby to produce the voltage $V_{XH}$ therefrom.

The control input of the analog multiplexer YM, on the other hand, is reduced to "0" thereby to produce the output $V_{XNS}$ therefrom. The control input of "0" level is applied to the analog multiplexers $YM_{21}$ to $YM_{25}$ corresponding to the second character to be erased thereby to produce the output $V_{XNS}$ therefrom. The control inputs of the other analog multiplexers take the level "1" thereby to produce the output $V_{YS}$ therefrom. As a result, the driving voltages applied to the X and Y electrodes are as shown in FIG. 9. The voltage waveforms applied to the respective liquid crystal cells under this condition will be described with reference to FIG. 10. The voltages $V_{XNS}$, $V_{YS}$ and $V_{XH}$ in FIG. 10 coincide with the waveforms of FIG. 4 and are applied to the X or Y electrode. As will be understood from FIG.

9, the respective X and Y electrodes included in the region covering the second character "B" in the first line to be erased are both impressed with the voltage $V_{XNS}$, with the result that the voltage applied to each liquid crystal cell in this region is reduced to zero and takes the state ⑤ as shown in FIG. 3, thus erasing the character "B". In the regions other than the region including the second character of the first line, the X and Y electrodes are respectively impressed with the voltages $V_{XNS}$ and $V_{YS}$, and therefore the voltage applied to each liquid crystal cell in such regions is $V_{XNS}-V_{YS}$ which assumes the waveform of (d) in FIG. 10. The effective value of this waveform voltage (d) is $(1/a)V_O$ and the holding voltage is $V_H$, thus maintaining the display condition as it is.

Figure 10:
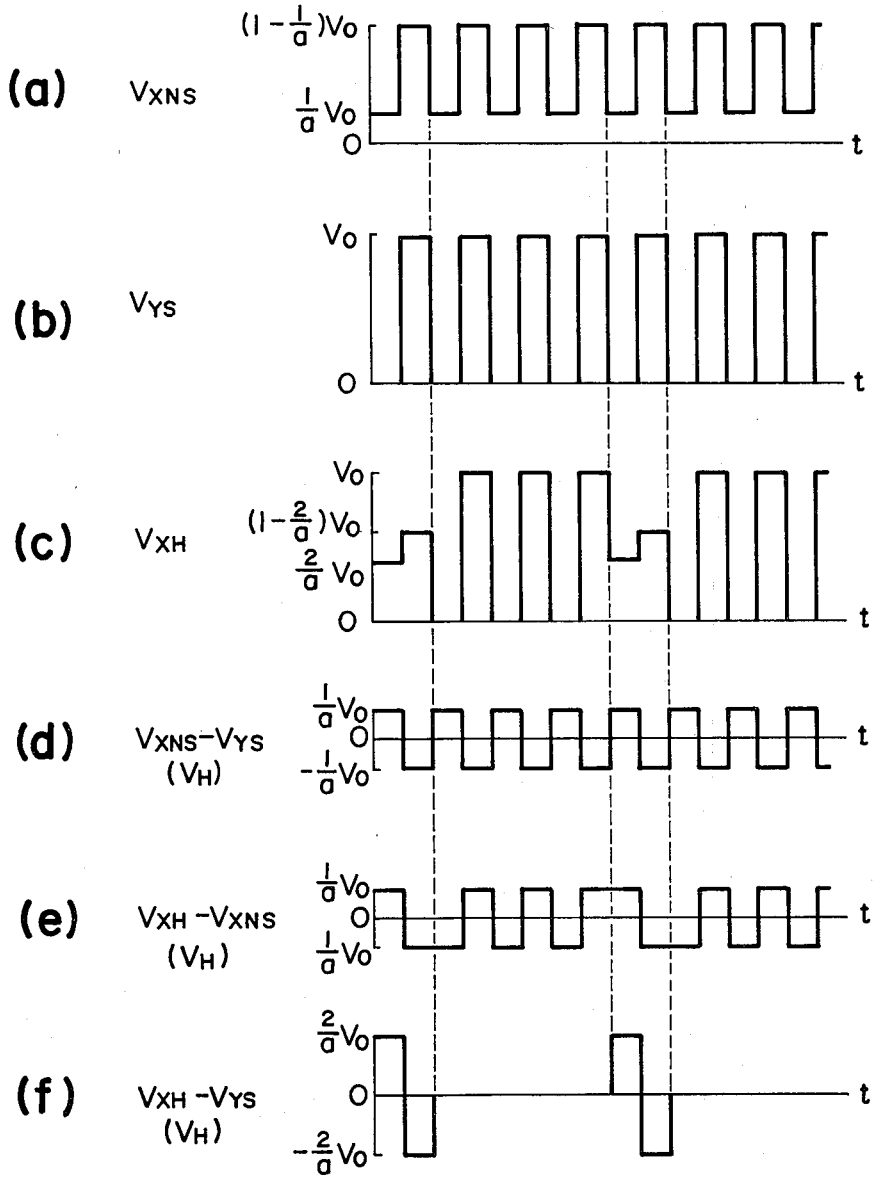
FIG. 10 shows waveforms of the voltages applied to the electrodes and the liquid crystal cells for partial erasure.

In FIG. 9, the region covering the second character "2" of the second line has the X electrodes impressed with the voltage $V_{XH}$ and the Y electrodes impressed with the voltage $V_{XNS}$, so that the liquid crystal cells in this region are impressed with the voltage difference $V_{XH}-V_{XNS}$ which has the waveform as shown in FIG. 10(*e*). This waveform voltage has the effective value of $(1/a)V_O$ and coincides with the holding voltage $V_H$, thus maintaining the display condition as it is.

In the region covering the second character of the second line in FIG. 9, the voltages $V_{XH}$ and $V_{YS}$ are applied to the X and Y electrodes respectively and therefore each liquid crystal cell in the particular region is impressed with the voltage difference $V_{XH-VYS}$. This voltage waveform is shown in FIG. 10(*f*), the effective value of which is calculated at $(1/a)V_O$ which coincides with the holding voltage $V_H$. In this region, therefore, the display condition is maintained as it is.

The voltage waveforms applied to the X and Y electrodes and the voltage waveform applied to the liquid crystal cells in each region for partial erasure mentioned above are shown collectively in FIG. 11.

Figure 12:
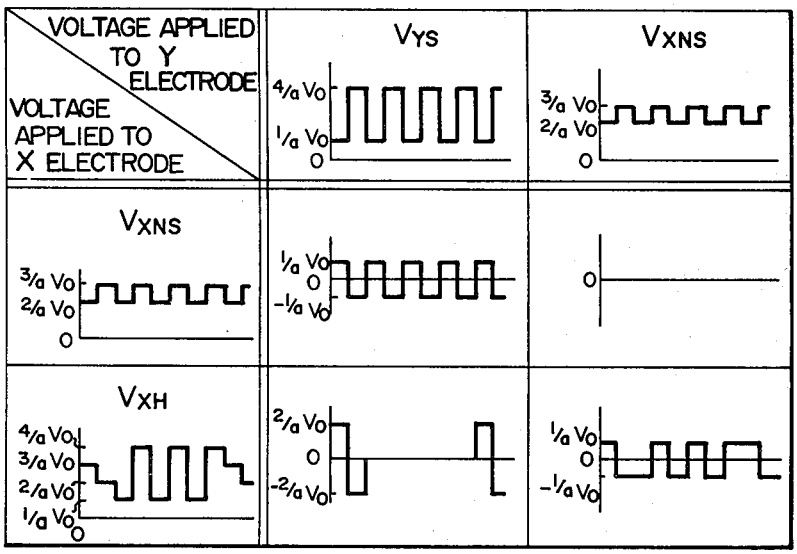
FIG. 12 is a diagram corresponding to FIG. 11 illustrating another embodiment having a different driving voltage waveform.

As seen from above, the part desired to be erased is erased under the state of ⑤ in FIG. 3, when the remaining parts are kept displayed under the condition ① or ④ thereby to achieve the partial erasure. By the way, FIG. 12 shows an example with a different driving waveform.

The above-mentioned driving conditions are summarized in Table 1 below.

TABLE 1

| | voltage applied to | drive state | | | | | |
|---|---|---|---|---|---|---|---|
| | | write | | hold | total erasure | partial erasure | |
| designated line | X electrode | scanning | | $V_{XNS}$ | $V_{XNS}$ | $V_{XNS}$ | |
| | Voltage applied to liquid crystal cell | (write) $V_S$ | (not write) $V_{NS}$ | (hold) $V_H$ | (erase) O | (erase) O | (hold) $V_H$ |
| | Y electrode | $V_{YS}$ | $V_{YNS}$ | $V_{YNS}$ | $V_{XNS}$ | $V_{XNS}$ | $V_{YS}$ |
| non-designated line | X electrode | $V_{XNS}$ | | $V_{XNS}$ | $V_{XNS}$ | $V_{HX}$ | |
| | Voltage applied to liquid crystal cell | (hold) $V_H$ | (hold) $V_H$ | (hold) $V_H$ | (erase) O | (hold) $V_H$ | (hold) $V_H$ |
| | Y electrode | $V_{YS}$ | $V_{YNS}$ | $V_{YNS}$ | $V_{XNS}$ | $V_{XNS}$ | $V_{YS}$ |

The foregoing description specifically refers to the display of characters of 5×7 dots in which the cells are scanned with 1/7 duty. This invention is not of course limited to such a case but is applicable with equal effect also to a case involving a different number of scanning lines or duty. Assume that a number N of scanning lines are involved. Then the voltages $V_S$, $V_{NS}$ and $V_H$ are written as follows:

$$V_S = \frac{V_0}{a}\sqrt{1+\frac{(a+1)(a-1)}{N}} \quad (4)$$

$$V_{NS} = \frac{V_0}{a}\sqrt{1+\frac{(a-1)(a-3)}{N}} \quad (5)$$

$$V_H = \frac{1}{a}V_0 \quad (6)$$

In this case, if the bias ratio a is determined to be $a=\sqrt{N}+1$, the ratio $V_S/V_{NS}$ is maximum and thus a better display is achieved.

When a=3, on the other hand, $V_{NS}=(1/a)V_O$ and therefore $V_{NS}=V_H$. Thus the state ① is exactly the same as the state ③ in FIG. 3, so that even a slight difference in brightness is eliminated, thus attaining a superior display.

Figure 13:
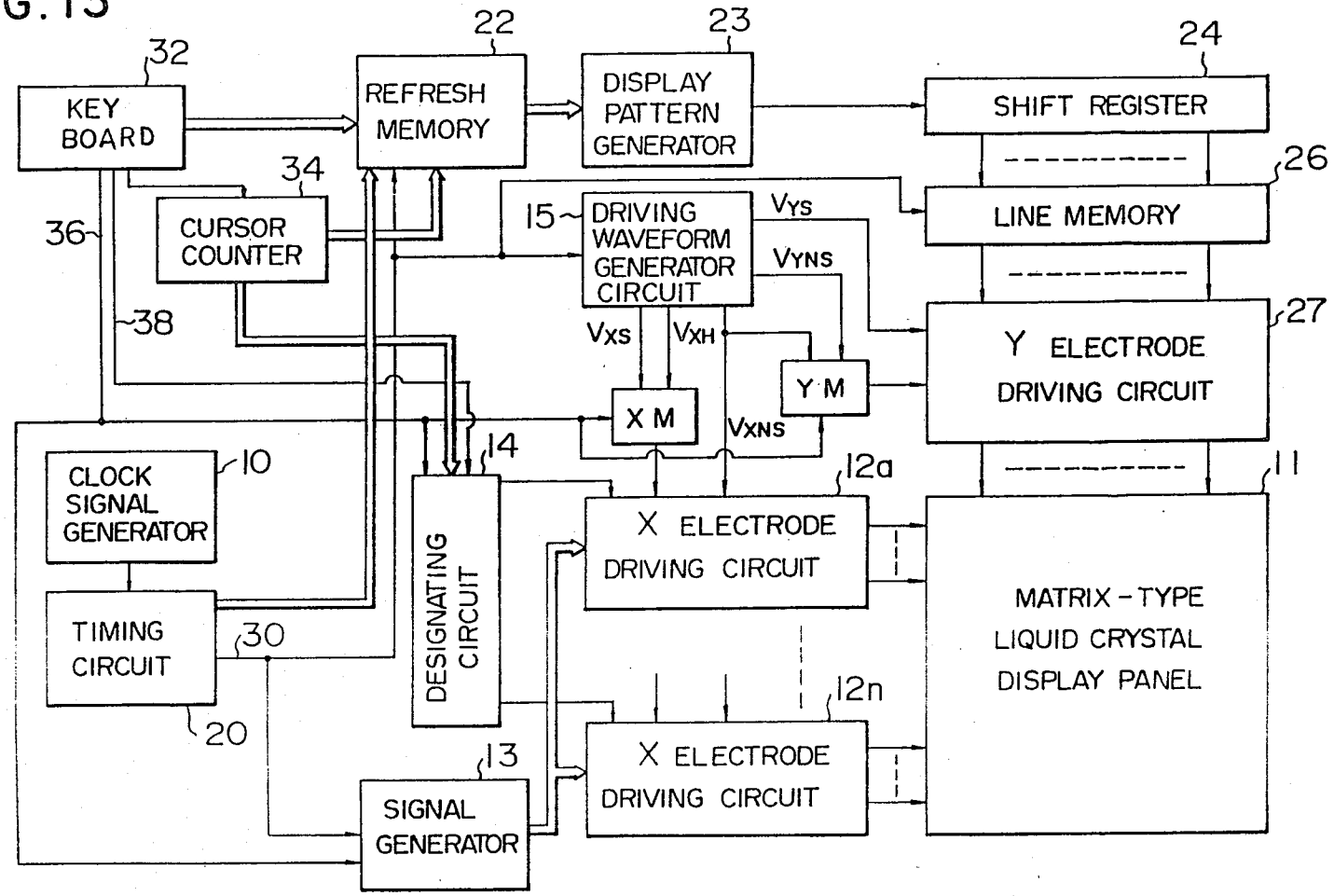
FIG. 13 shows a general configuration of an embodiment of the present invention.
Figure 13:
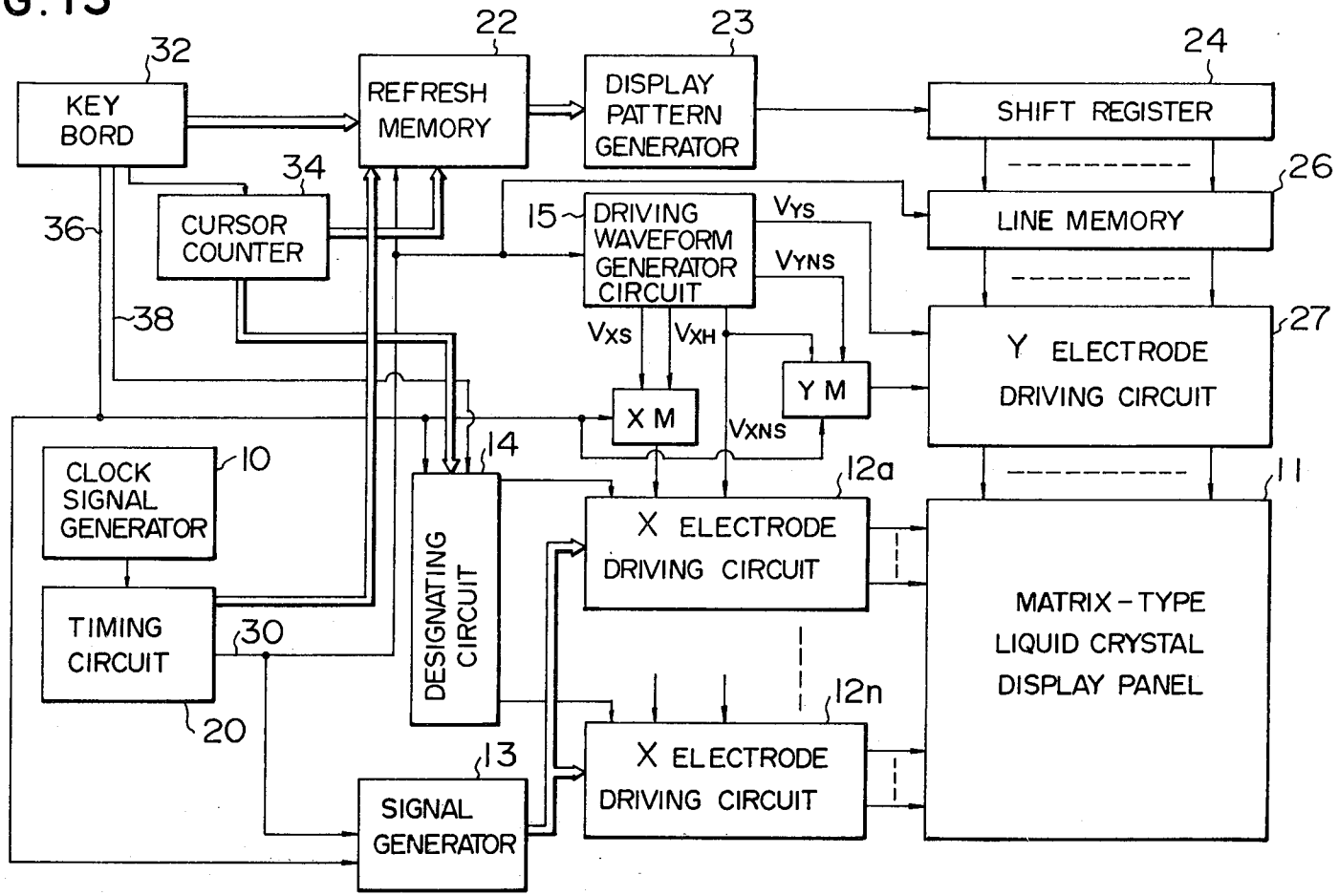

Now, an embodiment of the configuration of the present invention in a generalized form will be explained with reference to FIG. 13.

The liquid crystal display panel 11 is formed in matrix by the X and Y electrodes. The X electrodes form blocks of seven thereby to make up lines. The respective lines are supplied with the driving voltage from the X electrodes driving circuits 12*a* to 12*n* respectively. The X electrode driving circuits 12*a* to 12*n* are in turn supplied with control signals through seven signal lines corresponding to the respective X electrodes in the respective lines from the control signal generator 13. The designating circuit 14 designates the line to be written or erased, and produces only one "1" signal among the n outputs thereby to designate only one of the X electrode driving circuits 12*a* to 12*n*. The driving waveform generator circuit 15 corresponds to the circuit shown in FIG. 5 and is adapted to produce the selecting voltages $V_{XS}$, $V_{YS}$, the non-selecting voltages $V_{XNS}$, $V_{YNS}$ and the erasure holding voltage $V_{XH}$. The multiplexers XM and YM correspond to those described with reference to FIG. 6. In response to the control signal from the control signal generator 13, the X electrode driving circuits 12*a* to 12*n* designated by the designating circuit 14 apply the particular control signal to the multiplexer contained therein. The X electrode driving circuits not so designated receive the control signal in the form of "0" signal.

The timing circuit 20 contains a frequency divider which divides the clock pulses from the clock signal generator circuit 10 and generates a rectangular wave with 50% duty factor in synchronism with the driving voltage. This frequency divider substantially makes up a counter for generating an address for a refresh memory 22. The refresh memory 22 is for encoding and storing the information displayed on the display panel. The data read out according to the address from the timing circuit 20 is supplied to the display pattern generator circuit 23 where a video signal is generated on the basis of the display data and applied to the shift register 24. The shift register 24 subjects the video signal to a series-parallel conversion and transfers it to the line memory 26 in response to the instruction from the timing circuit 20. The video data stored in the line memory 26 are applied in the form of control signal to the analog multiplexers associated with the Y electrodes in the Y electrode driving circuit 27.

For the writing operation, the line and column of the part to be written is designated through the keyboard 32. Then the particular part is stored in the cursor counter 34. The data on the designated line in the cursor counter is supplied to the designating circuit 14 for line designation while supplying the address of the designated line to the refresh memory 22 at the same time. In synchronism with the rectangular signal from the timing circuit 20, the control signal generator circuit 13 is adapted to apply a "1" output signal to one of the seven output lines thereby to effect a line-at-a-time scanning of the designated line. The refresh memory 22 reads out the data corresponding to the respective electrodes in accordance with the line-at-a-time scanning synchronous with the rectangular wave pulses from the timing circuit 20. The part of the refresh memory 22 designated by the cursor counter 34 is supplied with the writing data from the keyboard 32, so that a predetermined character is written in the corresponding part on the display panel.

Figure 11:
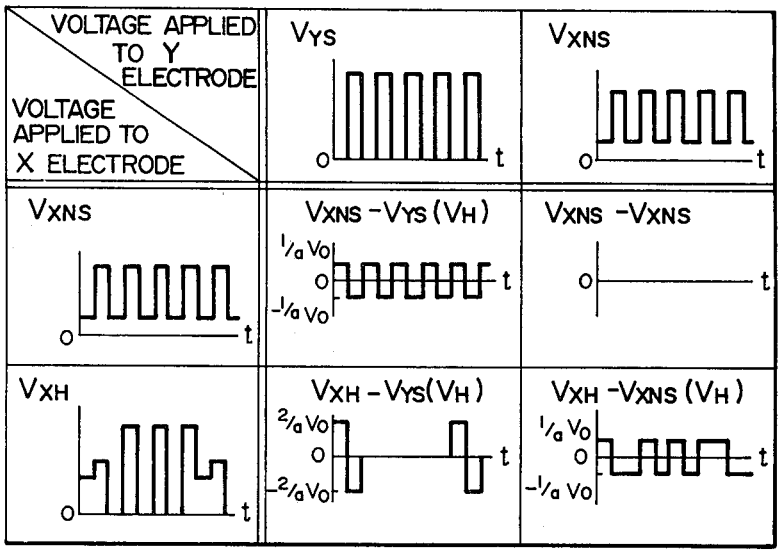
FIG. 11 is a diagram summarizing the waveforms of FIG. 10 for partial erasure.

At the time of partial erasure, the control signal which is normally at "1" level is produced at "0" level in the output line 36 of the keyboard 32. Then the analog multiplexers XM and YM produce the voltages $V_{XH}$ and $V_{XNS}$ respectively. Also, the control signal generator 13 produces "1" signals on all the output lines. The output of the designating circuit 14 is reversed thereby to apply a "0" signal only to the designated X electrode driving circuit. Further, the refresh memory 22 produces outputs of "0" for the designated part and "1" for the other parts. As a result, the voltages as shown in FIG. 11 are applied to the respective electrodes.

For the purposes of total erasure, the control signals on the lines 36 and 38 are reduced to "0" by the keyboard 32 and all the outputs of the designating circuit 14 are also reduced to zero. Under this condition, all the outputs of the refresh memory 22 are adapted to take the value "0".

To attain a holding state, on the other hand, the signal on the line 36 is rendered "1" and the designation of the cursor counter 34 is cancelled, thus reducing all the outputs of the designating circuit 14 to zero. Under this condition, all the outputs of the refresh memory 22 are rendered "0".

It will be understood from the foregoing description that according to the present invention partial erasure is possible in the liquid crystal display utilizing the hysteresis characteristic, thereby realizing a liquid crystal display apparatus of a high practical value.

What is claimed is:

1. An apparatus for driving a guest-host phase transition liquid crystal in matrix comprising:

(a) a plurality of liquid crystal display elements including a guest-host liquid crystal with a pleochroic dye added to one of the cholesteric-nematic liquid crystal and the chiralnematic phase transition liquid crystal, said liquid crystal display elements being driven by X and Y electrodes arranged in matrix, (b) a circuit generating a rectangular wave clock signal, (c) a drive waveform generator circuit for generating in synchronism with said rectangular wave clock signal an X electrode non-selecting voltage and an X electrode selecting voltage to be applied to said X electrodes and a Y electrode non-selecting voltage and a Y electrode selecting voltage to be applied to said Y electrodes, in order to supply each liquid crystal cell of said liquid crystal display elements with selected one of a holding voltage for holding the display condition and a write-in voltage for new writing operation, said drive waveform generator circuit further generating in synchronism with said rectangular wave clock signal an erasure holding voltage to be applied to one of said X and Y electrodes, said holding voltage being selected to be applied to the liquid crystal cells other than those liquid crystal cells to be erased when substantially the same waveform voltage is applied to the X and Y electrodes corresponding to the liquid crystal cells to be erased, in order to apply an erasure voltage to each liquid crystal cell positioned at the parts to be erased, (d) an X electrode driving circuit for supplying each of said X electrodes of said liquid crystal display elements with at least the X electrode non-selecting voltage and the X electrode selecting voltage selectively amoung the drive waveform voltages derived from said drive waveform generator circuit, (e) a Y electrode driving circuit for supplying each of said Y electrodes of said liquid crystal display elements with at least the Y electrode non-selecting voltage and the Y electrode selecting voltage selectively among the drive waveform voltages derived from said drive waveform generator circuit, (f) a change-over circuit for enabling the X electrode non-selecting voltage and the X electrode selecting voltage to be applied to said X electrode drive circuit and the Y electrode non-selecting voltage and the Y electrode selecting voltage to be applied to said Y electrode drive circuit at the time of execution of the writing operation, at least said X and Y electrode drive circuits being supplied with substantially the same waveform voltage while applying said erasure holding voltage to one of said X and Y drive circuits at the time of execution of the partial erasure, (g) a designating circuit for designating a region in the display panel of said liquid crystal display elements, where one of said write-in and partial erasure is to be executed, and (h) a control signal generator circuit for supplying a control signal to said X electrode drive circuit and said Y electrode drive circuit in such a manner that a write-in voltage is supplied to the liquid crystal cells to be written in the region designated by said designating circuit and a holding voltage is supplied to the other liquid crystal cells at the time of execution of the write-in operation, an erasure voltage being applied to the liquid crystal cells in the region designated by said designating circuit and a holding voltage being applied to the other liquid crystal cells at the time of execution of said partial erasure.

2. An apparatus for driving a guest-host phase transition liquid crystal in matrix according to claim 1, wherein said erasure holding voltage generated by said drive waveform generator circuit has a continuously repetitive pulse waveform including one cycle of said Y electrode non-selecting voltage and three cycles of said Y electrode selecting voltage, and said substantially same waveform voltage supplied to said X and Y electrode driving circuits from said change-over circuit is the X electrode non-selecting voltage, said change-over circuit supplying said erasure holding voltage to said X electrode driving circuit at the time of execution of said partial erasure.

3. An apparatus for driving a guest-host type phase transition liquid crystal in matrix according to claim 1 or 2, wherein said X electrodes in the region designated by said designating circuit are N in number, and the bias ratio of the X and Y electrode drive waveform voltages generated in said drive waveform generator circuit is $\sqrt{N+1}$ when said X electrodes in the number N in said designated region are subjected to a line-at-a-time scanning at the time of execution of write-in operation.

4. An apparatus for driving a guest-host type phase transition liquid crystal in matrix according to claim 1 or 2, wherein the bias ratio of said X and Y drive waveform voltages generated in said drive waveform generator circuit is 3 when the X electrodes in said region designated by said designating circuit are subjected to a line-at-a-time scanning at the time of execution of the write-in operation.

5. An apparatus for driving a guest-host type phase transition liquid crystal in matrix according to claim 1, wherein said control signal generator circuit operates at the time of execution of said partial erasure in such a manner that said same waveform voltage is applied to the X and Y electrodes located in the region designated by said designating circuit, one of the other X and Y electrodes is impressed with said erasure holding voltage, the remaining electrodes being impressed with one of said drive waveform voltages other othan said same waveform voltage and said erasure holding voltage.

6. A method for driving a guest-host type phase transition liquid crystal in matrix comprising a plurality of liquid crystal display elements including a guest-host liquid crystal with a pleochroic dye added to one of the cholesteric-nematic phase transition liquid crystal and the chiralnematic phase transition liquid crystal, said liquid crystal display elements being driven by X and Y electrodes arranged in matrix;

said method comprising steps of generating in synchronism with a rectangular wave clock signal an X electrode non-selecting voltage and an X electrode selecting voltage to be applied to said X electrodes and a Y electrode non-selecting voltage and a Y electrode selecting voltage to be applied to said Y electrodes, in order to supply each liquid crystal cell of said liquid crystal display elements with selected one of a holding voltage for holding the display condition and a write-in voltage for new writing operation, said drive waveform generator circuit further generating in synchronism with said rectangular wave clock signal an erasure holding voltage to be applied to one of said X and Y electrodes, said holding voltage being substantially selected to be applied to the liquid crystal cells other than the liquid crystal cell to be erased when substantially the same waveform voltage is applied to the X and Y electrodes corresponding to the liquid crystal cell to be erased, in order to apply an erasure voltage to each liquid crystal cell positioned at the parts to be erased;

supplying the X electrode non-selecting voltage and the X electrode selecting voltage selectively to the X electrodes covering the liquid crystal cells to be written, the other X electrodes being supplied with the X electrode non-selecting voltage, the Y electrode non-selecting voltage and the Y electrode selecting voltage being selectively supplied to the Y electrodes covering the liquid crystal cells to be written, the other Y electrodes being supplied with the non-selecting voltage, in such a manner that the write-in voltage is supplied to the liquid crystal cells to be written in the region designated and the other liquid crystal cells are supplied substantially with the holding voltage at the time of execution of writing operation; and supplying the same waveform voltage to the X and Y electrodes covering the liquid crystal cells in the region designated to be erased, one of the other X and Y electrodes being supplied with said erasure holding voltage, the other of said X and Y electrodes being supplied with one of said non-selecting voltages and said selecting voltages other than said same waveform voltage at the time of execution of partial erasure.

* * * * *